United States Patent [19]

Miers

[11] Patent Number: 4,689,143

[45] Date of Patent: Aug. 25, 1987

[54] DRUM SEPARATOR

[75] Inventor: Robert M. Miers, Appleton, Wis.

[73] Assignee: Kimberly-Clark Corporation, Neenah, Wis.

[21] Appl. No.: 834,291

[22] Filed: Feb. 26, 1986

[51] Int. Cl.[4] ..... B07B 1/22; D01B 9/00

[52] U.S. Cl. ..... 209/240; 19/200; 19/205; 55/290; 209/250; 209/255; 209/285

[58] Field of Search ..... 209/21–23, 209/28–31, 44.3, 146, 147, 154, 240, 250, 255, 270, 279, 284, 285, 295, 380, 235; 19/97, 112, 200, 205, 304; 55/210, 283, 290, 294, 351; 210/107, 143, 402, 406

[56] References Cited

U.S. PATENT DOCUMENTS

| | | | |
|---|---|---|---|
| 1,610,053 | 12/1926 | Holmes | 55/351 |
| 2,009,140 | 7/1935 | Knowlton | 55/290 |
| 2,632,923 | 3/1953 | Nisbet, Sr. | 19/72 |
| 2,783,888 | 3/1957 | Dahlstrom et al. | 209/295 |
| 3,002,621 | 10/1961 | Mathewson | 209/250 |
| 3,051,998 | 9/1962 | Rust, Jr. et al. | 19/307 |
| 3,397,778 | 8/1968 | Karlsson | 209/147 X |
| 3,572,011 | 3/1971 | Wilhelmsson | 55/290 |
| 3,667,195 | 6/1972 | Angilly, Jr. et al. | 55/290 X |
| 3,712,549 | 1/1973 | Cleemann | 241/19 |
| 3,727,755 | 4/1973 | Cristiani | 209/45 |
| 4,042,503 | 8/1977 | Justus | 209/240 X |
| 4,192,749 | 3/1980 | Jackson | 210/107 |
| 4,222,754 | 9/1980 | Horvat | 55/290 X |
| 4,229,286 | 10/1980 | Bridges | 209/22 |
| 4,377,401 | 3/1983 | Laughlin | 209/23 X |
| 4,479,286 | 10/1984 | Brown et al. | 19/200 |

FOREIGN PATENT DOCUMENTS

| | | | |
|---|---|---|---|
| 1004461 | 3/1957 | Fed. Rep. of Germany | 209/23 |
| 3131174 | 2/1983 | Fed. Rep. of Germany | 19/200 |
| 0749538 | 5/1956 | United Kingdom | 19/205 |

*Primary Examiner*—Randolph A. Reese
*Assistant Examiner*—Edward M. Wacyra
*Attorney, Agent, or Firm*—Gregory E. Croft; Donald L. Traut; Jeremiah J. Duggan

[57] ABSTRACT

A drum separator includes a cylindrical screen drum which is mounted for rotation within a sealed housing such that a small portion of the perimeter of the screen drum is exposed. Air, fibers, and fines are introduced onto a first part of the exposed portion of the screen drum and fines and air pass through the screen drum into the interior of the housing and then to a fines collector. Fibers which are too large to pass through the screen drum are carried by the rotation of the screen drum to a pick-up head which applies a low pressure to the exterior of the screen drum to remove the fibers. The pick-up head is pivotably mounted to the housing, and air cylinders lift the pick-up head away from the screen drum in the event of an impact. The pick-up head includes a pick-up bar and a plurality of fins which are shaped to optimize removal of fibers from the exterior of the screen drum.

36 Claims, 10 Drawing Figures

DRUM SEPARATOR

BACKGROUND OF THE INVENTION

The present invention relates to a rotating drum separator useful for separating fibers from fines in an air flow.

Rotating drum separators have been widely used in the past in applications such as air filtration and tobacco separation. U.S. Pat. Nos. 2,009,140, 3,472,002, 3,667,195, and 4,222,754 provide several examples of air filters based on the rotating drum principle. In each case, substantially the entire periphery of the drum is exposed to the air flow to be filtered, and air velocity through the screening medium of the drum is thereby minimized. U.S. Pat. Nos. 2,783,888 and 3,727,755 illustrate pneumatic separators used to separate tobacco leaves from stems and the like.

Air filtration applications and tobacco separation applications differ in important respects from the problems solved with the present invention. In particular, the preferred embodiments described below of the drum separator of this invention operate to segregate fines from fibers in an air flow in a rapid and efficient manner.

SUMMARY OF THE INVENTION

The separator of this invention comprises a screen drum; means for introducing a mixture of fines and fibers entrained in a gas flow onto the screen drum; means for withdrawing gas and fines which have passed through the screen drum from the separator; and means for creating a low pressure region in order to remove fibers from the screen drum which have not passed through the screen drum. A number of improvements to such drum-type separators are described below in detail, which can be used either separately or together to enhance the efficiency of the separator.

According to a first feature of this invention, the screen drum is enclosed in a sealed housing which substantially completely surrounds the screen drum such that only a small portion of the screen drum extends outside the housing. The mixture of fines and fibers is introduced onto the screen drum at a first location on the exposed portion of the screen drum and a low pressure region is created at a second location on the exposed portion of the screen drum. Means are provided for rotating the screen drum to carry fibers from the first location to the second location and means are provided for sealing the housing around the exposed portions of the screen drum to substantially prevent fibers from entering the housing. Fines and gas which have passed through the screen drum into the housing are removed from the housing by the withdrawing means.

This feature of the invention reduces the area of the screen drum that is exposed to a pressure differential at any given time. For this reason, this feature of the invention increases the pressure differential across the screen drum for a given vacuum system, thereby increasing the velocity of gas flow across the screen drum. In this way, the fibers are held securely against the screen drum as they are moved from the first to the second location, and fines are efficiently transported across the screen drum itself.

According to a second feature of this invention, fibers are removed from the screen drum by a vacuum pick-up head which is mounted adjacent to the drum. Means are provided for automatically moving the pick-up head away from the drum in response to excessive forces applied to the pick-up head in order to protect the screen drum from damage. In operation, foreign material or simply damp clumps of fiber can jam between the pick-up head and the screen drum. Such jamming may cause damage to the fine screen mesh included on the screen drum, and the automatic moving means of this invention operates to minimize such damage.

According to a third feature of this invention, fibers are withdrawn from the screen by a vacuum pick-up head which comprises a pick-up bar mounted to the pick-up head to extend along the drum. This pick-up bar defines a forward face and a rearward face which meet at an apex line which extends along the drum. The rearward face is oriented substantially radially with respect to the drum and the forward face is oriented at an inclination of about 60° to about 70° with respect to the rearward face. This geometry has been found to provide excellent removal of the fiber from the surface of the screen drum. Preferably, a plurality of spaced, parallel fins is provided, each of which defines an edge oriented generally parallel to the apex line of the pick-up bar and positioned adjacent to the drum. These fins have been found to create turbulence which operates to remove additional fiber left behind by the pick-up bar from the drum.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
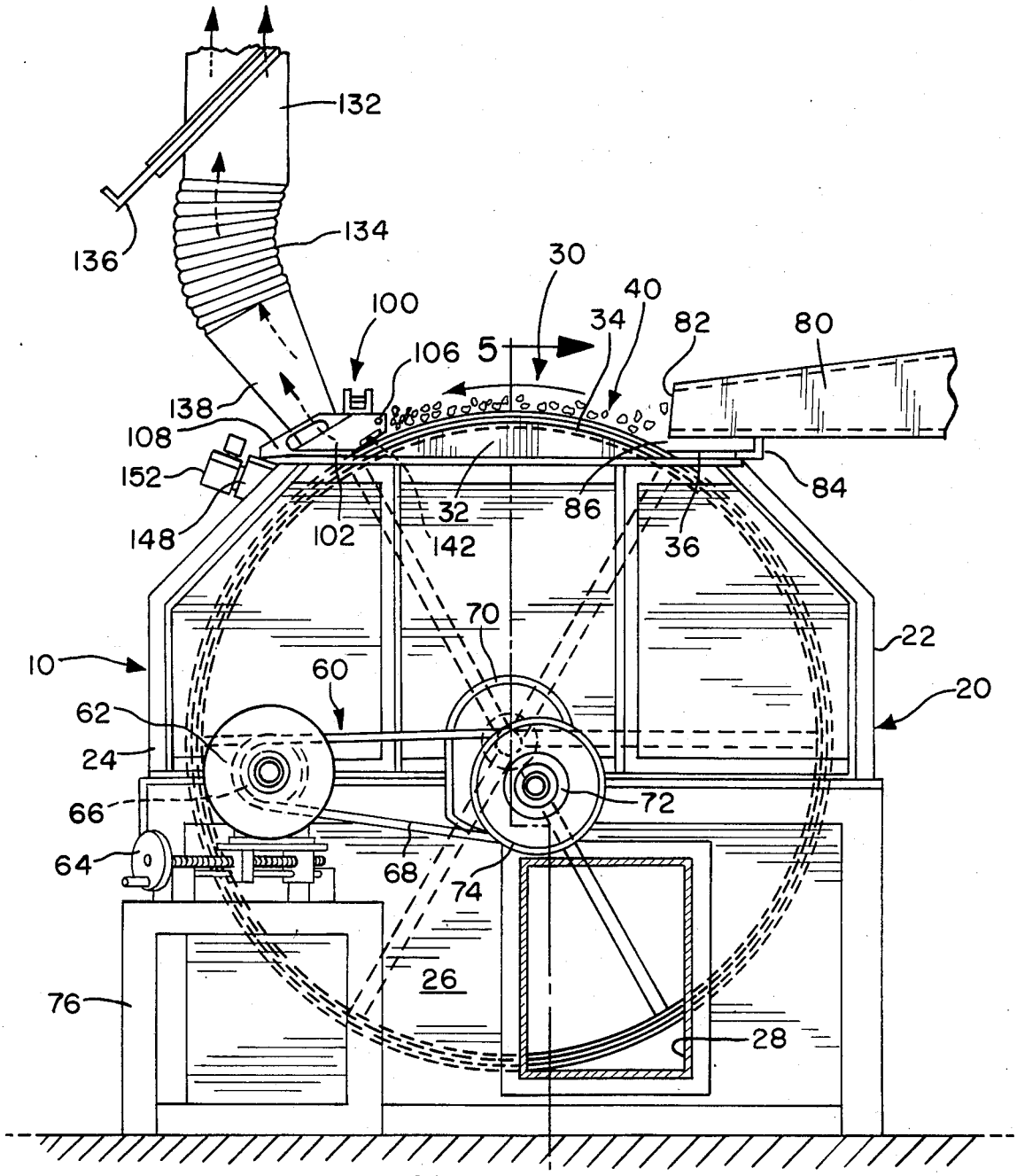
FIG. 1 is a side elevation of a separator which incorporates a presently preferred embodiment of this invention.

Turning now to the drawings, FIG. 1 shows a side elevation of a separator 10 which incorporates a presently preferred embodiment of this invention. The separator 10 includes an enclosed, sealed housing 20 which comprises a front panel 22, a back panel 24, and two end panels 26. Each of the end panels 26 defines a respective duct opening 28 near a lower edge of the respective end panel. The front and back panels 22, 24 do not meet at the top of the housing 20, thereby creating a top opening 30 therebetween.

Figure 3:
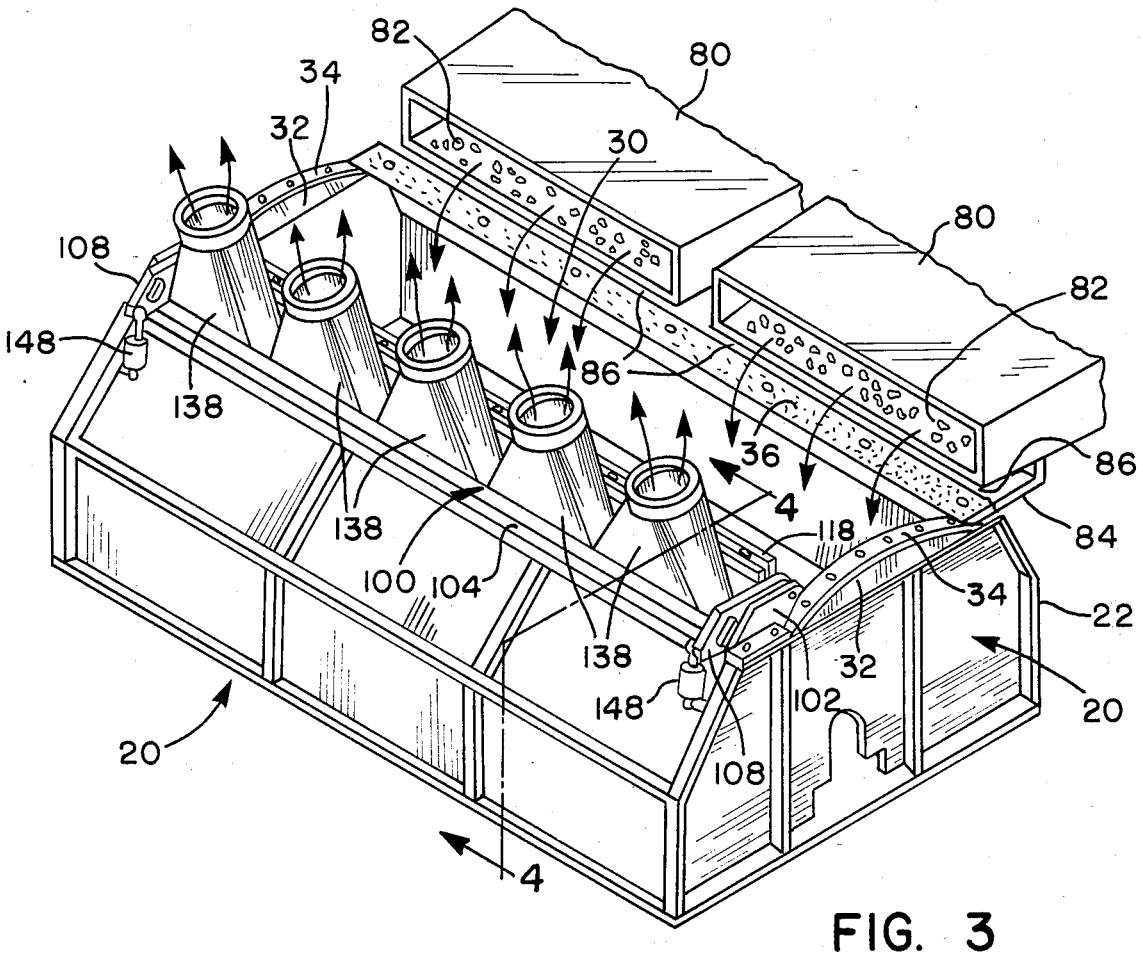
FIG. 3 is a perspective of upper portions of the embodiment of FIG. 1.

Spaced, parallel seal mounts 32 are mounted to the upper edges of the end panels 26. Each of these seal mounts 32 defines an arcuate upper surface which serves to support a respective side seal 34. The side seals 34 are aligned with one another and face one another across the top opening 30. Each of the side seals 34 extends inwardly from the respective seal mount 32, as shown in FIG. 3. In addition, a front seal 36 is rigidly mounted to the housing 20 adjacent to the top opening 30, extending generally between the two seal mounts 32.

Figure 2:
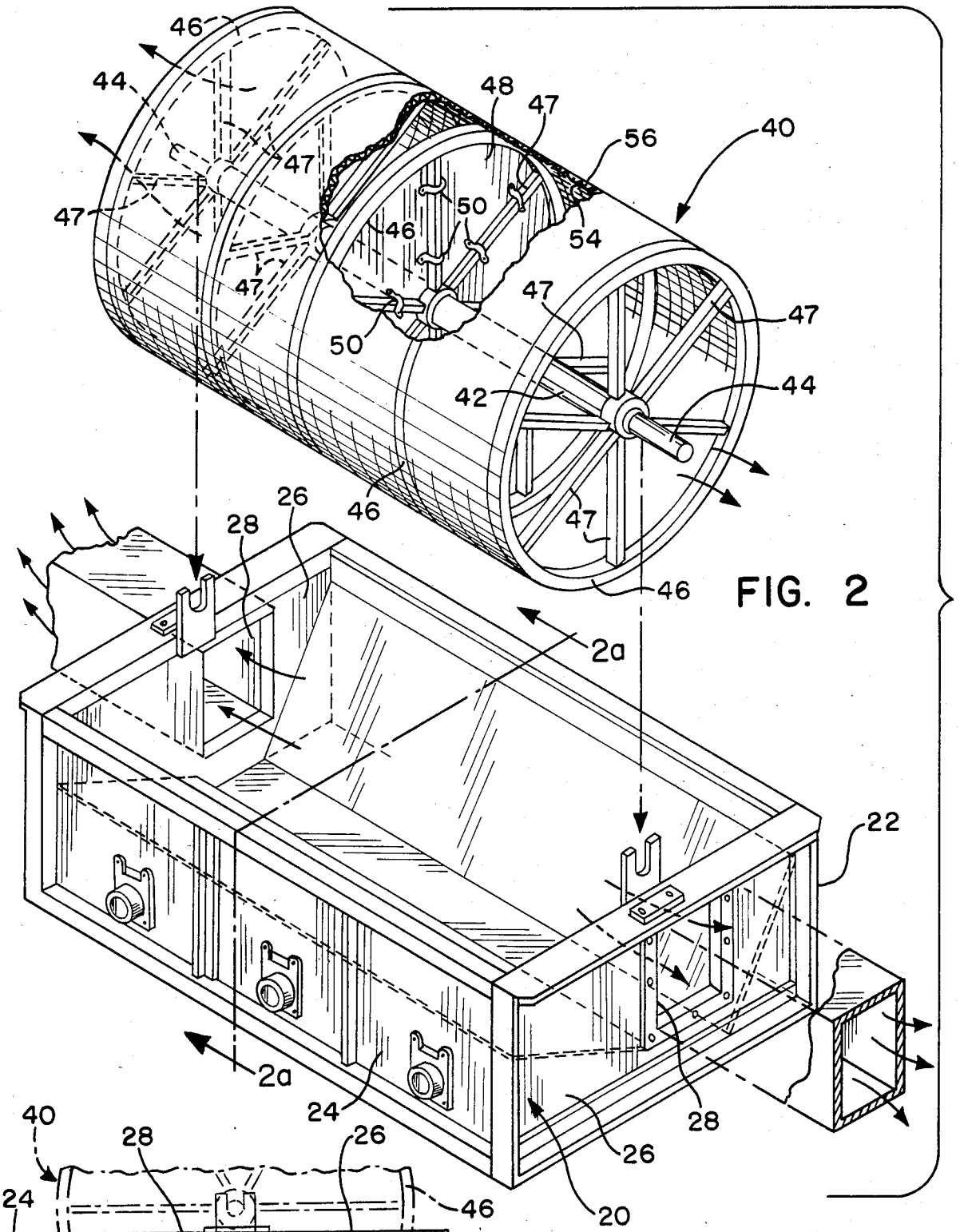
FIG. 2 is an exploded perspective of lower portions of the embodiment of FIG. 1.
Figure 2A:
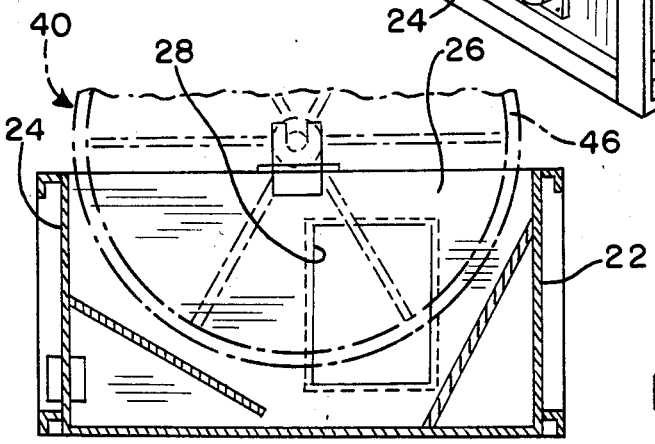
FIG. 2*a* is a section taken along line 2*a*—2*a* of FIG. 2.
Figure 5:
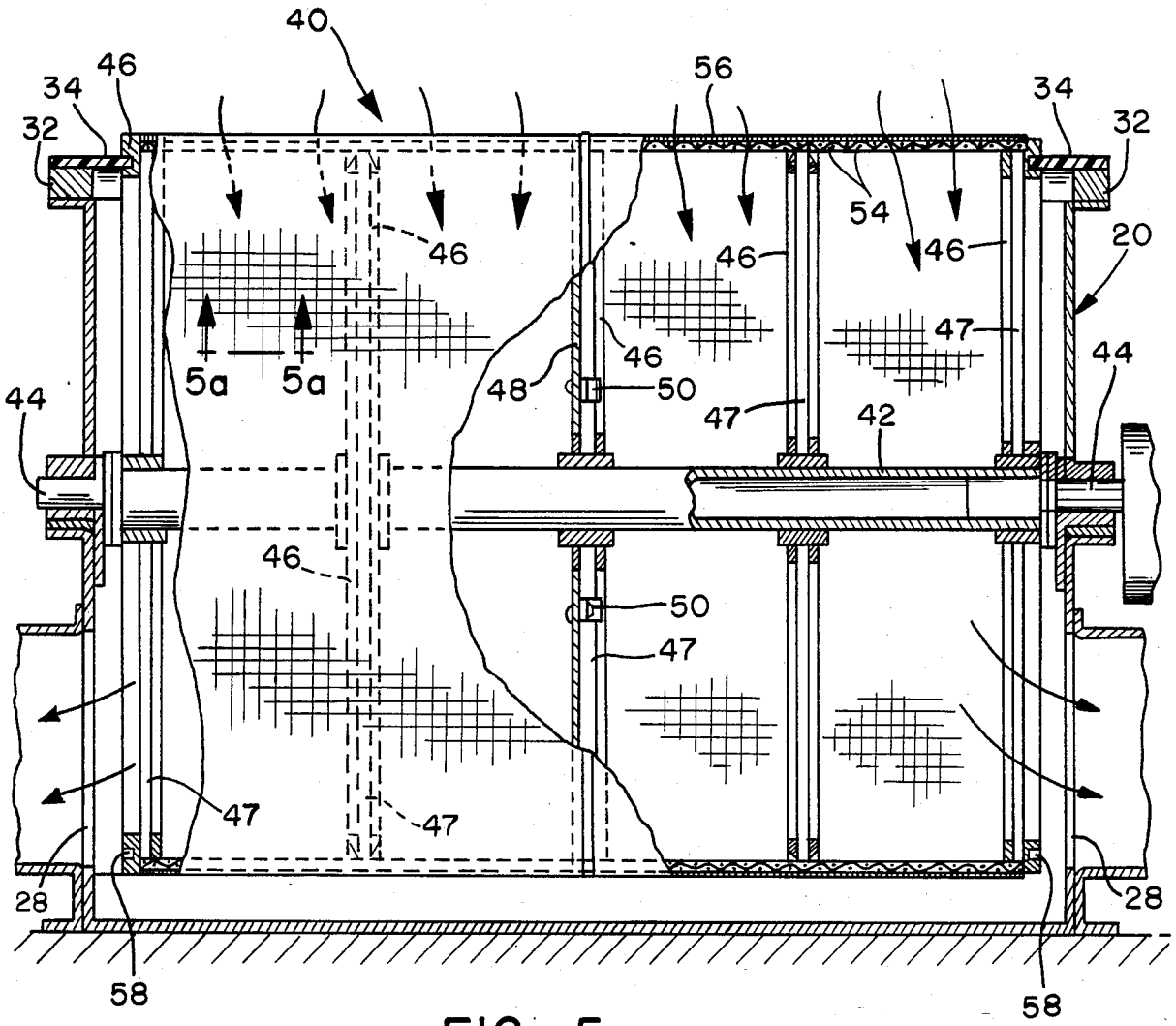
FIG. 5 is a section taken along line 5—5 of FIG. 1.
Figure 5A:
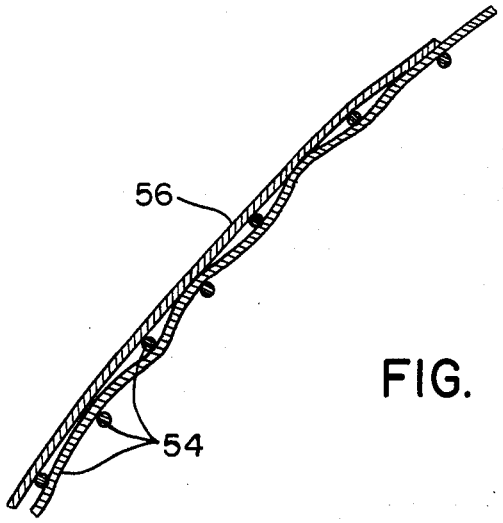
FIG. 5*a* is a section taken along line 5*a*—5*a* of FIG. 5.

A screen drum 40 is mounted for rotation within the housing 20. The screen drum 40 is best shown in FIGS. 2 and 5, and it includes a central, axially extending shaft 42 which terminates at each end in a respective axle 44. A total of five wheels 46 are rigidly mounted to the shaft 42, and each of the wheels 46 defines an array of spokes 47. The central one of the wheels 46 serves to mount an imperforate plate 48 which is held in place by means of a plurality of clamps 50 which secure the plate 48 to the spokes 47 of the central wheel 46. The outer face of each of the outer wheels 46 defines an annular groove 58 shaped to receive the respective side seal 34. A coarse screen 54 is welded in place to the wheels 46, and this coarse screen 54 in turn supports a fine screen 56 (FIG. 5*a*). In this embodiment the fine screen 56 is held in place by an axial solder joint joining the ends of the fine screen. However, a flattened expanded metal sheet having, for example, a diamond-shaped pattern can also be used in place of the woven screens.

The screen drum 40 is mounted within the housing 20 by bearings, and the openings in the housing 20 through which the shaft 42 passes are sealed to prevent air leakage into the housing 20 around the axles 44. When the screen drum 40 is mounted in place in the housing 20, the side seals 34 fit within the grooves 58 to create a labyrinthian seal between the screen drum 40 and the seal mounts 32. The front seal 36 extends between the two ends 26 of the housing 20 to a point closely adjacent to the fine screen 56. In this way, the housing 20 is substantially sealed around the screen drum 40 by contact-free seals which do not rub against the screen drum 40.

The separator 10 includes a drive system 60 for rotating the screen drum 40. This drive system 60 includes an electric motor 62 which is adjustably mounted on a motor base 64, which is in turn mounted on a drive base 76. The electric motor 62 rotates a variable speed sheave 66 which is coupled via a belt 68 with a drive sheave 74. The drive sheave 74 is connected by a reducer 70 and a clutch 72 to one of the axles 44 of the screen drum 40. Thus, rotation of the motor 62 results in rotation of the screen drum 40. The clutch 72 allows the screen drum 40 to be soft-started, so that the rotational speed of the screen drum 40 can be gradually increased to the point where there is no slippage across the clutch 72. The variable speed sheave 66 allows the rotational speed of the screen drum 40 to be adjusted as desired.

As shown in FIGS. 1 and 3, a pair of aligned chutes 80 is mounted over the front seal 36. Each of the chutes 80 defines a respective discharge end 82 which is positioned to discharge a flow of air, fibers, and fines onto the exposed portion of the screen drum 40. The chutes 80 are held in place by support brackets 84 which are arranged to insure that an air gap 86 is maintained between the discharge end 82 of the chutes 80 and the front seal 36. This air gap 86 insures that any leakage between the front seal 36 and the screen drum 40 includes a minimum of fibers. In this way, the air gap 86 assists in sealing the interior of the housing 20 against fibers.

Figure 1A:
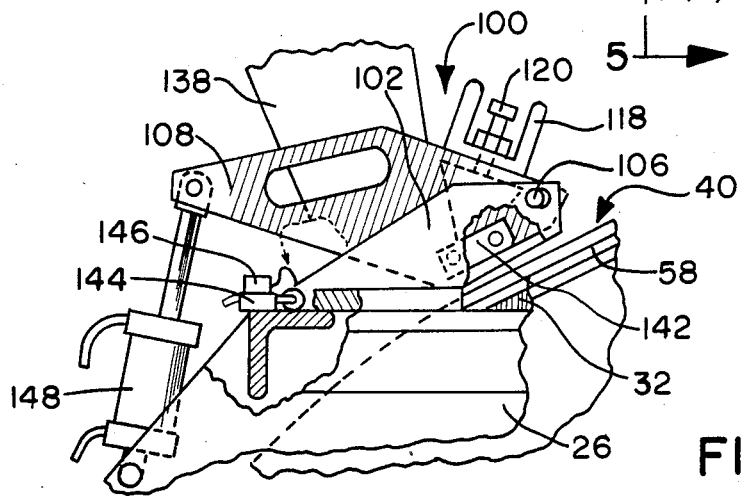
FIG. 1*a* is an enlarged side elevation of a portion of the embodiment of FIG. 1, showing the pick-up head in a raised position.
Figure 4:
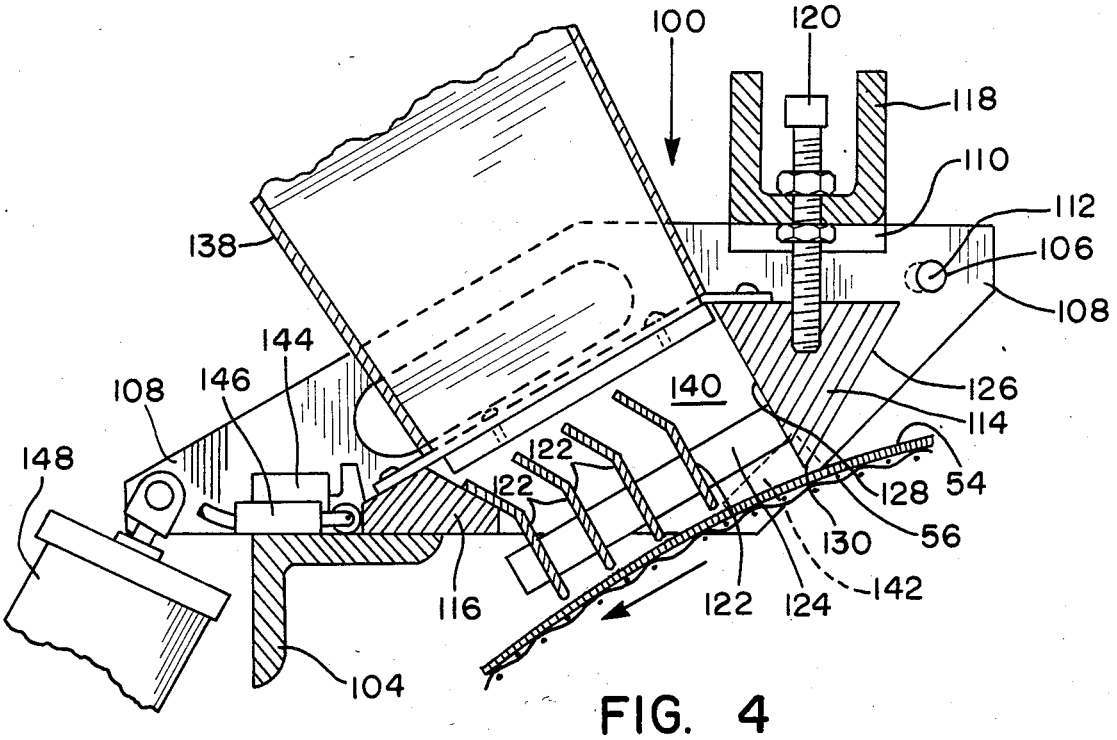
FIG. 4 is a section taken along line 4—4 of FIG. 3.

Turning now to FIGS. 3 and 4, the separator 10 includes a pick-up head 100 which is pivotably mounted to the housing 20 by two parallel mounting brackets 102. (See FIG. 1*a*.) Each of the mounting brackets 102 is rigidly mounted to a respective one of the end panels 26. A stop 104 is mounted between the end panels 26 to provide a precisely determined rest position for the pick-up head 100. Each of the mounting brackets 102 defines a slightly oblong opening 106 which allows the pick-up head 100 to move from left to right as shown in FIG. 4 by a small amount (about 1/16 of an inch in this embodiment).

The pick-up head 100 includes two parallel side plates 108, each of which includes a respective inwardly extending bracket 110. Each of the side plates 108 is pivotably mounted to the associated mounting bracket 102 at a pivot axis 112. The two side plates 108 are rigidly secured at respective ends of a pick-up bar 114, a cross brace 116, and a pick-up bar support 118 to form a rigid unit which is pivotably mounted between the mounting brackets 102 at the pivot axis 112. In this embodiment, two spaced screws 120 are adjustably secured to the pick-up bar support 118 and threaded into the pick-up bar 114. These screws 120 can be used to deflect the pick-up bar 114 as necessary to achieve a constant gap between the pick-up bar 114 and the screen 56 of the screen drum 40.

In this embodiment, four spaced, parallel fins 122 are mounted in place between the cross brace 116 and the pick-up bar 114. A plurality of fin supports 124 extends between the fins 122 and the pick-up bar 114 to hold the fins 122 rigidly in position.

The pick-up bar 114 defines a front face 126 and a rear face 128 which meet at an apex line 130. In this embodiment, the rear face 128 is oriented radially to extend generally perpendicularly to the cylindrical surface of the screen drum 40. The front face 126 defines an included angle of 60° with respect to the rear face 128, and the angle between the front face 126 and the cylindrical surface of the screen drum 40 is therefore about 30°. In this embodiment the stop 104 is positioned and the fins 122 and the pick-up bar 114 are adjusted such that the radial separation between the cylindrical fine screen 56 and the adjacent surfaces of the fins 122 and the pick-up bar 114 is in the range of 1/16 to ⅛ of an inch.

As shown in FIGS. 1 and 3, a side-by-side array of air ducts 132 is provided, and each of the ducts 132 terminates at its lower end in a respective flexible region 134. Each of the ducts 132 includes a slide damper 136 that can be used to regulate the flow of air through the respective duct 132. The lower end of each of the flexible regions 134 is secured to the upper end of a respective transition piece 138. Adjacent transition pieces 138 are secured together, and the transition pieces 138 are secured at their lower ends between the cross brace 116 and the pick-up bar 114. The region between the side plates 108, the pick-up bar 114, and the cross brace 116 defines a generally rectangular vacuum chamber 140. When the pick-up head 100 is in the position shown in FIG. 4, this vacuum chamber 140 is positioned directly adjacent to the fine screen 56. Two pick-up seal 142 are mounted to the side plates 108 to seal the vacuum chamber 140 at either side against the end face of the screen drum 40.

As pointed out above, the oblong openings 106 in the mounting brackets 102 allow the pick-up head 100 to slide in a horizontal plane by about 1/16 of an inch. Two spring stops 144 are mounted to the stop 104 to bias the pick-up head 100 in the direction of the chutes 80. A switch 146 is mounted to the stop 104 to sense the position of the pick-up head 100. During normal operation, the pick-up head 100 is positioned away from the switch 146 by the spring stops 144, and the switch 146 is open. In the event an excessive force is applied to the pick-up head 100, as for example by a foreign object striking the pick-up head 100 after being discharged by the chute 80, the pick-up head 100 will move toward the switch 146 against the biasing force of the spring stops 144, thereby closing the switch 146.

Figure 6:
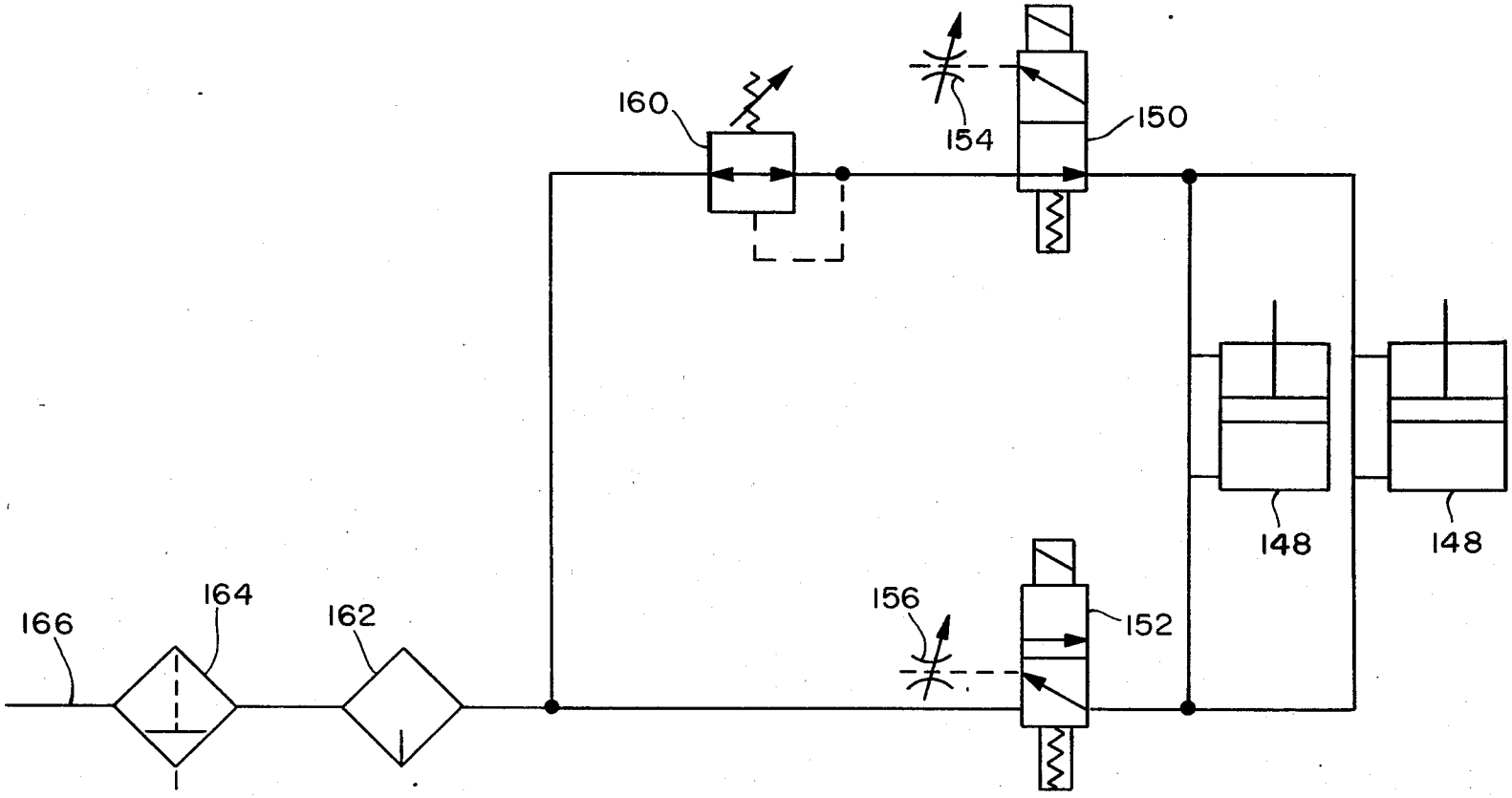
FIG. 6 is a schematic diagram of the pneumatic system of the embodiment of FIG. 1.

As shown in FIGS. 3 and 4, air cylinders 148 are coupled between the side plates 108 and the housing 20. The cylinders 148 are included in a pneumatic circuit as shown in FIG. 6, which operates from compressed air supplied from an air line 166. This pneumatic circuit includes a conventional lubricator 164 and a conventional filter 162. A regulator 160 regulates air pressure supplied to the upper chamber of the cylinder 148. Two solenoid valves 150, 152 are operated in parallel and are controlled by the switch 146. FIG. 6 shows the solenoid valves 150, 152 in their normal position, when the switch 146 is open. When the solenoid valves 150, 152 are unenergized, the solenoid valve 150 passes pressurized air to the upper chamber of the air cylinders 148, and the solenoid valve 152 vents the lower chamber of the air cylinders 148.

Under these circumstances, the air cylinders 148 provide a resilient biasing force holding the pick-up head 100 against the stop 104. The regulator 160 should preferably be adjusted to provide only enough pressure to overcome forces tending to lift the pick-up head 100 in normal operation. When the switch 146 is closed by rearward movement of the pick-up head 100, an electrical relay provides sustained power to the valves 150, 152 moving them to the alternate position, in which the upper chambers of the air cylinders 148 are vented via the vent 154, and the lower chambers of the air cylinders 148 are supplied with pressurized air. When this happens the air cylinders 148 extend, pivoting the pick-up head 100 about the pivot axis 112 and quickly increasing the separation of the fins 122 and the pick-up bar 114 from the screen drum 40.

An electrical reset removes power from the valves 150 and 152, returning the pick-up head 100 to its operating position at a velocity governed by the size of the vent 156.

Figure 7:
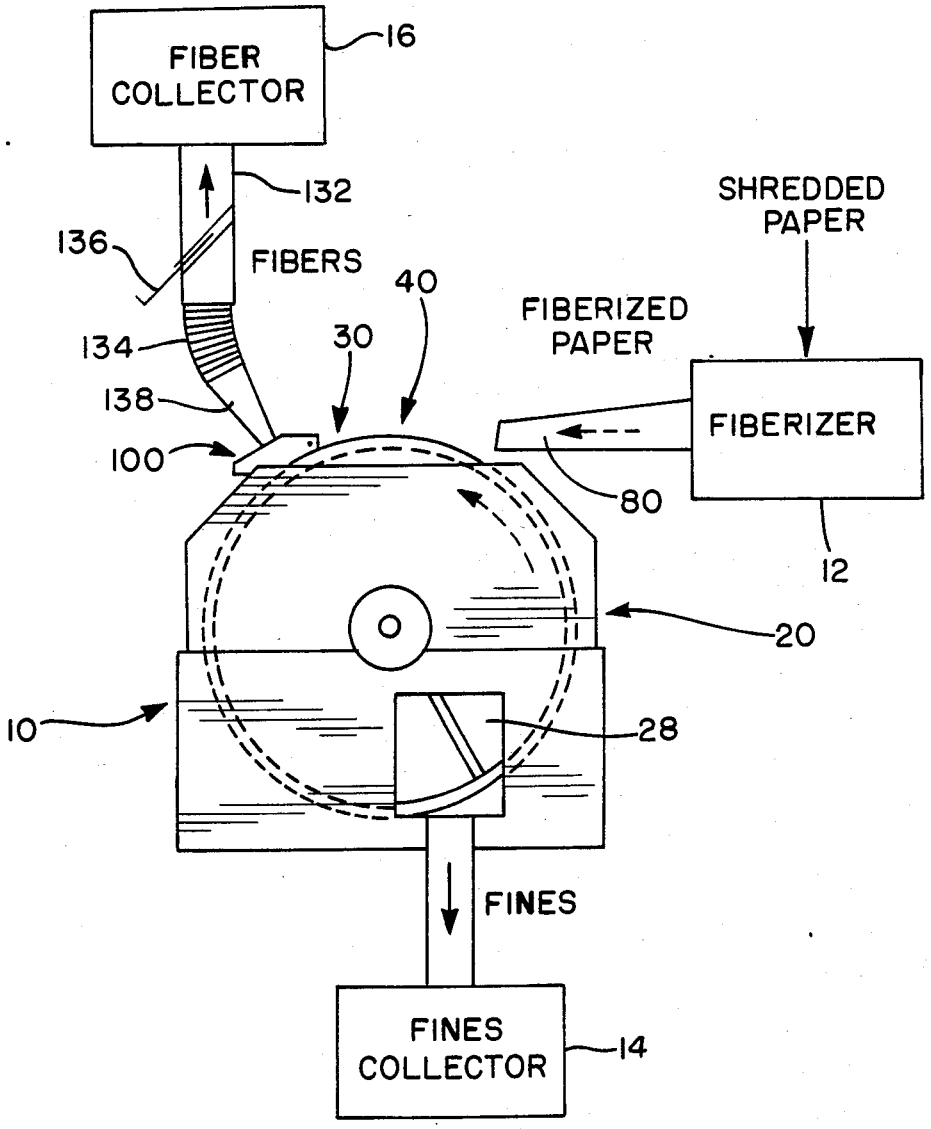
FIG. 7 is a schematic diagram of a dry de-inking system utilizing the embodiment of FIGS. 1–6.

FIG. 7 shows an example of the manner in which the separator 10 can be used in a dry de-inking operation of the type described in co-pending application Ser. No. 06/554,174, assigned to the assignee of the present invention. This dry de-inking operation includes a fiberizer 12 which operates to convert shredded paper into substantially discrete fibers and fines. Preferably, the paper is air dry when introduced into the fiberizer 12. The output of the fiberizer 10 is connected to the chutes 80, and thus the fiber and fines which exit from the fiberizer are applied to the exposed portion of the screen drum 40. The ducts 132 are connected to a fiber collector 16, and the end openings 28 are connected to a fines collector 14. The top opening 30 remains open to the atmosphere. Purely by way of example, in this embodiment the screen drum is rotated to provide a linear speed of 3,000 feet per minute to the fine screen 56. The dampers 136 in the ducts 132 are adjusted to provide a vacuum of about 14 inches of water below atmospheric pressure in the vacuum chamber 140. Fans are provided in the fines collectors 14 to provide a vacuum of between four and seven inches of water below atmospheric pressure within the housing 20. Generally, the fiberizer 12 is operated to provide a pressure about one inch of water above atmospheric pressure in the chutes 80.

The drive system 60 rotates the drum 40 such that the drum 40 moves from the region of the chutes 80 toward the region of the pick-up head 100 (counterclockwise in the view of FIGS. 1 and 7). The low pressure within the housing 20 insures that fibers and fines move toward the fine screen 56 of the screen drum 40. Relatively high velocity air flow moves through the exposed portion of the screen drum 40, thereby carrying ink bearing fines which can pass through the fine screen 56 into the interior of the screen drum 40 and the housing 20. These fines are then drawn to the fines collector 14 via the end openings 28. Fibers which are too large to pass through the fine screen 56 are carried by the rotation of the screen drum 40 to the pick-up head 100. The inclined front face 26 of the pick-up bar 114 cooperates with the sharp apex line 130 and the perpendicular surface of the rear face 128 to create an abrupt pressure change at the apex line 130.

As explained above, the pressure in the vacuum chamber 140 is less than the pressure in the housing 20, and air is removed from the housing 20 through the fine screen 56 into the vacuum chamber 140. This causes fibers on the screen drum 40 to be lifted off the screen drum 40 and carried via the transition pieces 138 into the ducts 132. The geometry described above for the pick-up bar 114 insures the removal of the large majority of the fiber from the screen drum 40. However, some of the fiber remains on the screen drum 40, and the fins 122 remove a major portion of this remaining fiber. It is believed that the fins 122 create turbulence in the vacuum chamber 140 which loosens and removes fiber that has remained in place. In this way, the quantity of fiber entering the housing 20 is minimized.

In general, the rotation rate of the drum 40 should be selected to provide the desired quality of separation. Excessively low drum speed results in an excessively thick mat of fibers and fines on the screen which reduces the quality of separation. In this embodiment, the drum 40 is preferably rotated at about 190 rpm.

The following details of construction are provided in order better to define the presently preferred embodiment of this invention. It should be clearly understood that these details are provided only by way of illustration, and are not intended in any way to limit the scope of this invention. In this embodiment, the drum 40 is about 80 inches in length and about 60 inches in diameter. The coarse screen 54 is made of wire having a diameter of 0.092 inches, with adjacent wires separated from one another by ¾ inch in each dimension. The fine screen 56 in this embodiment is a stainless steel wire cloth having 150 wires per linear inch in each dimension. The wire cloth supplied by C. E. Tyler Co. of Menton, Ohio as type 304 stainless steel cloth (0.0026 inch wire diameter) has been used satisfactorily. In this embodiment, the side seal 34, the front seal 36 and the pick-up seals 142 are all formed of high density polyethylene. Each of the seals is preferably a non-contact seal which minimizes friction, rubbing and damage to the screen 56.

The spring force of the spring stops 144 should be chosen to allow ready tripping of the switch 146, without unnecessary interruptions in operation. At present, two spring stops 144 are used, each of which develops a spring force of 12 pounds.

From the foregoing, it should be apparent that an efficient and relatively inexpensive drum separator has been described. This separator is characterized by a complete absence of rubbing seals, and is well suited to high speed, high volume separation. It is relatively simple and inexpensive to manufacture, and reliable and efficient in operation.

Of course, it should be understood that a wide range of changes and modifications can be made to the preferred embodiment described above. For example, this invention is not limited to use in de-inking systems, and the terms "fibers" and "fines" are intended broadly to encompass material which is too large to pass through the screen and material which is small enough to pass through the screen, respectively. In addition, the invention is not limited to use with wire cloth, and the term "screen" is used in its broad sense to cover a wide range of filter media. It is therefore intended that the foregoing detailed description be regarded as illustrative rather than limiting, and that it be understood that it is the following claims, including all equivalents, which are intended to define the scope of this invention.

I claim:

1. A separator for separating fines from fibers in a gas flow, said separator comprising:

a screen drum;

an enclosed housing which substantially completely surrounds the screen drum such that only an exposed portion of the screen drum extends outside the housing;

means for introducing a mixture of fines and fibers entrained in a gas flow onto the screen drum at a first location on the exposed portion of the screen drum;

means for withdrawing from the housing gas and fines which have passed through the screen drum into the housing;

means for creating a low pressure region at a second location on the exposed portion of the screen drum in order to remove fibers from the screen drum which have not passed through the screen drum, wherein said means for creating a low pressure region comprises means for defining a low pressure chamber adjacent to the screen drum, said chamber comprising a pick-up bar which extends across the screen drum and defines a leading edge of the chamber, said pick-up bar defining a first surface extending substantially perpendicularly to the screen drum and facing toward the chamber and a second surface extending at an angle of 60° to 70° to the first surface and facing away from the chamber, said first and second surfaces meeting in a line which extends across the drum;

means for rotating the drum to carry fibers from the first location to the second location; and means for sealing the housing around the exposed portion of the screen drum to substantially prevent fibers from entering the housing.

2. The invention of claim 1 wherein the exposed portion of the drum extends over an arc of less tha 90° of the drum.

3. The invention of claim 1 wherein the low pressure creating means comprises:

a low pressure chamber;

means for pivotably mounting the chamber to the housing;

means for biasing the chamber to an operating position in which the chamber is positioned closely adjacent to the screen drum;

means for generating a control signal in response to an impact to the chamber;

means, responsive to the control signal, for moving the chamber away from the screen drum following an impact to the chamber; and means for maintaining the chamber at a lower pressure than the interior of the screen drum.

4. The invention of claim 3 wherein the chamber defines a forward end nearer the first location and a rearward end farther from the first location, and wherein the chamber pivots about a pivot axis situated nearer the forward end than the rearward end.

5. The invention of claim 1 wherein the sealing means comprises:

means for defining an annular groove in at least one end of the screen drum; and a seal plate mounted to the housing adjacent said at least one end of the screen drum, said seal plate comprising an arcuate seal strip mounted to the seal plate to fit into the groove, thereby creating a labyrinthian seal between the seal plate and the screen drum.

6. The invention of claim 1 wherein the sealing means comprises a screen seal positioned adjacent to a cylindrical screen surface defined by the drum, and wherein the introducing means comprises a chute oriented to direct the flow of gas and entrained fibers and fines tangentially onto the cylindrical screen surface.

7. The invention of claim 6 wherein the chute is spaced from the screen seal by an air passage to reduce the flow of fibers into the housing.

8. The invention of claim 1 wherein the means for creating a low pressure region comprises a plurality of fins, each extending across the screen drum and positioned closely adjacent to the drum such that the drum moves past the fins successively as the drum rotates, each of the fins contributing to the removal of the fibers from the drum.

9. The invention of claim 1 wherein the means for creating a low pressure region comprises:

an elongated low pressure chamber positioned adjacent the drum;

a plurality of vacuum ducts; and means for interconnecting the chamber and the ducts such that the ducts draw air and fibers from the screen drum and through the chamber.

10. The invention of claim 9 wherein at least one of the ducts comprises a respective damper effective to balance pressure in a first portion of the chamber aligned with the one duct as compared with a second portion of the chamber spaced from the first portion.

11. The invention of claim 1 wherein the withdrawing means comprises first and second ducts, each mounted to the housing adjacent a respective end of the screen drum.

12. The invention of claim 11 wherein the screen drum comprises an imperforate plate extending completely across the drum in a center region of the drum.

13. A separator for separating fines from fibers in a gas flow, said separator comprising:

a screen drum;

means for rotating the screen drum;

means for directing a flow of gas, fibers, and fines onto the screen drum;

means for withdrawing air and fines which have passed through the drum from the interior of the drum;

a vacuum pick-up head mounted adjacent to the drum to remove fibers from the screen, said pick-up head comprising: a pick-up bar mounted to the pick-up head to extend along the drum, said pick-up bar defining a forward face and a rearward face which meet at an apex line which extends along the drum, said rearward face oriented substantially radially with respect to the drum, said forward face oriented at an inclination of about 60° to 70° with respect to the rearward face; and means for creating a low pressure region adjacent to the rearward face; and means for automatically moving the pick-up head away from the drum in response to execessive forces applied to the pick-up head in order to protect the screen drum from damage.

14. The invention of claim 13 wherein the pick-up head further comprises a plurality of spaced, parallel fins, each defining an edge oriented generally parallel to the apex line and positioned adjacent to the drum, and wherein the low pressure region extends adjacent to each of the edges.

15. The invention of claim 13 wherein the pick-up head comprises:

means for defining a generally rectangular pick-up region adjacent to the drum;

a plurality of vacuum ducts;

means for interconnecting the vacuum ducts and the pick-up region; and means for balancing air flow in the ducts to equalize air flow across the pick-up region.

16. The invention of claim 13 wherein the withdrawing means comprises:

an enclosed housing which surrounds a major portion of the drum such that a portion of the drum is exposed, the directing means directs the flow at a first location on the exposed part of the drum, and the pick-up head is mounted at a second location on the exposed part of the drum; and means for sealing the housing around the exposed portion of the drum to prevent the flow of fibers into the housing.

17. The invention of claim 16 wherein the sealing means comprises:

means for defining first and second annular grooves at adjacent ends of the drum; and first and second arcuate seal strips, each mounted to the housing to fit within the respective groove in order to form a labyrinthian seal between the housing and the ends of the drum.

18. The invention of claim 16 wherein the exposed portion of the drum is no more than about 90° of arc of the drum.

19. A separator for separating fines from fibers in a gas flow, said separator comprising:

a screen drum;

means for rotating the screen drum;

means for directing a flow of gas, fibers, and fines onto the screen drum;

means for withdrawing air and fines which have passed through the drum from the interior of the drum;

a vacuum pick-up head mounted adjacent to the drum to remove fibers from the screen; and means for automatically moving the pick-up head away from the drum in response to excessive forces applied to the pick-up head in order to protect the screen drum from damage, wherein the moving means comprises:

means for pivotably mounting the pick-up head to pivot about an axis;

means for biasing the pick-up head to a rest position adjacent to the drum;

means for generating a control signal in response to the application of excessive forces to the pick-up head; and means for automatically pivoting the pick-up head around the axis away from the drum in response to the control signal.

20. A separator for separating fines from fibers in a gas flow, said separator comprising:

a screen drum;

means for rotating the screen drum;

means for directing a flow of gas, fibers, and fines onto the screen drum;

means for withdrawing air and fines which have passed through the drum from the interior of the drum; and a vacuum pick-up head mounted adjacent to the drum to remove fibers from the screen;

said vacuum pick-up head comprising:

a pick-up bar mounted to the pick-up head to extend along the drum, said pick-up bar defining a forward face and a rearward face which meet at an apex line which extends along the drum, said rearward face oriented substantially radially with respect to the drum, said forward face oriented at an inclination of about 60° to about 70° with respect to the rearward face; and means for creating a low pressure region adjacent to the rearward face.

21. The invention of claim 20 wherein the pick-up head further comprises a plurality of spaced, parallel fins, each defining an edge oriented generally parallel to the apex line and positioned adjacent to the drum, and wherein the low pressure region extends adjacent to each of the edges.

22. The invention of claim 20 wherein the pick-up head comprises:

means for defining a generally rectangular pick-up region adjacent to the drum;

a plurality of vacuum ducts;

means for interconnecting the vacuum ducts to the pick-up region; and means for balancing air flow in the ducts to equalize air flow across the pick-up region.

23. The invention of claim 20 wherein the withdrawing means comprises:

an enclosed housing which surrounds a major portion of the drum such that a portion of the drum is exposed, the directing means directs the flow at a first location on the exposed part of the drum, and the pick-up head is mounted at a second location on the exposed part of the drum; and means for sealing the housing around the exposed portion of the drum to prevent the flow of fibers into the housing.

24. The invention of claim 23 wherein the exposed portion of the drum is no more than about 90° of arc of the drum.

25. A separator for separating fines from fibers in a gas flow, said separator comprising:

a screen drum;

an enclosed housing which substantially completely surrounds the screen drum such that only an exposed portion of the screen drum extends outside the housing;

meaans for introducing a mixture of fines and fibers entrained in a gas flow onto the screen drum at a first location on the exposed portion of the screen drum;

means for withdrawing from the housing gas and fines which have passed through the screen drum into the housing;

means for creating a low pressure region at a second location on the exposed portion of the screen drum in order to remove fibers from the screen drum which have not passed through the screen drum wherein the low pressure creating means comprises:

a low pressure chamber;

means for pivotably mounting the chamber to the housing;

means for biasing the chamber to an operating position in which the chamber is positioned closely adjacent to the screen drum;

means for generating a control signal in response to an impact to the chamber;

means, responsive to the control signal, for moving the chamber away from the screen drum following an impact to the chamber; and means for maintaining the chamber at a lower pressure than the interior of the screen drum;

means for rotating the drum to carry fibers from the first location to the second location; and means for sealing the housing around the exposed portion of the screen drum to substantially prevent fibers from entering the housing.

26. The invention of claim 25 wherein the chamber defines a forward end nearer the first location and a rearward end farther from the first location, and wherein the chamber pivots about a pivot axis situated nearer the forward end than the rearward end.

27. A separator for separating fines from fibers in a gas flow, said separator comprising:

a screen drum;

an enclosed housing which substantially completely surrounds the screen drum such that only an exposed portion of the screen drum extends outside the housing;

means for introducing a mixture of fines and fibers entrained in a gas flow onto the screen drum at a first location on the exposed portion of the screen drum;

means for withdrawing from the housing gas and fines which have passed through the screen drum into the housing;

means for creating a low pressure region at a second location on the exposed portion of the screen drum in order to remove fibers from the screen drum which have not passed through the screen drum;

means for rotating the drum to carry fibers from the first location to the second location; and means for sealing the housing around the exposed portion of the screen drum to substantially prevent fibers from entering the housing.

28. The invention of claim 27 wherein the exposed portion of the drum extends over an arc of less than 90° of the drum.

29. The invention of claim 27 wherein the sealing means comprises:

means for defining an annular groove in at least one end of the screen drum; and a seal plate mounted to the housing adjacent said at least one end of the screen drum, said seal plate comprising an arcuate seal strip mounted to the seal plate to fit into the groove, thereby creating a labyrinthian seal between the seal plate and the screen drum.

30. The invention of claim 27 wherein the sealing means comprises a screen seal positioned adjacent to a cylindrical screen surface defined by the drum, and wherein the introducing means comprises a chute oriented to direct the flow of gas and entrained fibers and fines tangentially onto the cylindrical screen surface.

31. The invention of claim 30 wherein the chute is spaced from the screen seal by an air passage to reduce the flow of fibers into the housing.

32. The invention of claim 27 wherein the means for creating a low pressure region comprises a plurality of fins, each extending across the screen drum and postioned closely adjacent to the drum such that the drum moves past the fins successively as the drum rotates, each of the fins contributing to the removal of the fibers from the drum.

33. The invention of claim 27 wherein the means for creating a low pressure region comprises:

an elongated low pressure chamber positioned adjacent the drum;

a plurality of vacuum ducts; and means for interconnecting the chamber and the ducts such that the ducts draw air and fibers from the screen drum and through the chamber.

34. The invention of claim 33 wherein at least one of the ducts comprises a respective damper effective to balance pressure in a first portion of the chamber aligned with the one duct as compared with a second portion of the chamber spaced from the first portion.

35. The invention of claim 27 wherein the withdrawing means comprises first and second ducts, each mounted to the housing adjacent a respective end of the screen drum.

36. The invention of claim 35 wherein the screen drum comprises an imperforate plate extending completely across the drum in a center region of the drum.

* * * * *